US011767668B2

(12) United States Patent
Wilby

(10) Patent No.: US 11,767,668 B2
(45) Date of Patent: Sep. 26, 2023

(54) MODULAR BUILDING SYSTEM AND METHOD

(71) Applicant: Purpose Built Systems Ltd., Vancouver (CA)

(72) Inventor: Myles W. Wilby, Vancouver (CA)

(73) Assignee: Purpose Built Systems Ltd., Vancouver (CA)

( * ) Notice: Subject to any disclaimer, the term of this patent is extended or adjusted under 35 U.S.C. 154(b) by 0 days.

(21) Appl. No.: 16/895,798

(22) Filed: Jun. 8, 2020

(65) Prior Publication Data

US 2020/0385980 A1 Dec. 10, 2020

Related U.S. Application Data

(60) Provisional application No. 62/858,683, filed on Jun. 7, 2019.

(51) Int. Cl.
*E04B 1/348* (2006.01)

(52) U.S. Cl.
CPC ..... *E04B 1/34823* (2013.01); *E04B 1/34861* (2013.01)

(58) Field of Classification Search
CPC .. E04B 1/34861; E04B 1/34823; E04H 1/005
See application file for complete search history.

(56) References Cited

U.S. PATENT DOCUMENTS 3,835,601 A * 9/1974 Kelbish ..... E04B 1/34823 52/79.2
4,195,453 A * 4/1980 Komendant ..... E04B 1/04 52/79.13
4,277,921 A * 7/1981 Gianfranco ..... E04B 1/046 52/79.4
4,485,598 A * 12/1984 Guardiani ..... E04C 3/34 52/745.03
5,103,604 A * 4/1992 Teron ..... E04B 1/34861 52/126.3
7,185,467 B2 * 3/2007 Marty ..... E04B 1/165 52/259

(Continued)

FOREIGN PATENT DOCUMENTS

CH 471301 A * 4/1969 ..... E04B 1/34823
DE 2926969 A1 * 1/1980 ..... E04B 1/34823

OTHER PUBLICATIONS

DE 292969 Machine Translation from Espacenet. Accessed Jul. 20, 2020.*

*Primary Examiner* — Christine T Cajilig

(74) *Attorney, Agent, or Firm* — Todd A. Rattray; Oyen Wiggs Green & Mutala LLP

(57) ABSTRACT

The present disclosure describes a modular building system and method adapted to achieve a more efficient and durable longer-term building solution that can resist adverse weather conditions, natural disasters, and common building material degradation for years or decades, and can be built on remote sites that may otherwise be cost prohibitive to build permanent structures using more conventional building methods. In accordance with an illustrative embodiment, the modular building system comprises of a modular unit that is formed into a unitary building structure that may be interconnected laterally or vertically to form two or more floors.

18 Claims, 16 Drawing Sheets

(56) References Cited

U.S. PATENT DOCUMENTS

| | | | | |
|---|---|---|---|---|
| 2006/0196132 | A1* | 9/2006 | Ruano | E04G 21/142<br>52/236.3 |
| 2012/0110928 | A1* | 5/2012 | Liberman | E04G 21/14<br>52/122.1 |
| 2018/0030718 | A1* | 2/2018 | Aguila | E04B 1/16 |
| 2019/0136508 | A1* | 5/2019 | Chaillan | B28B 7/0091 |

* cited by examiner

FIG. 11
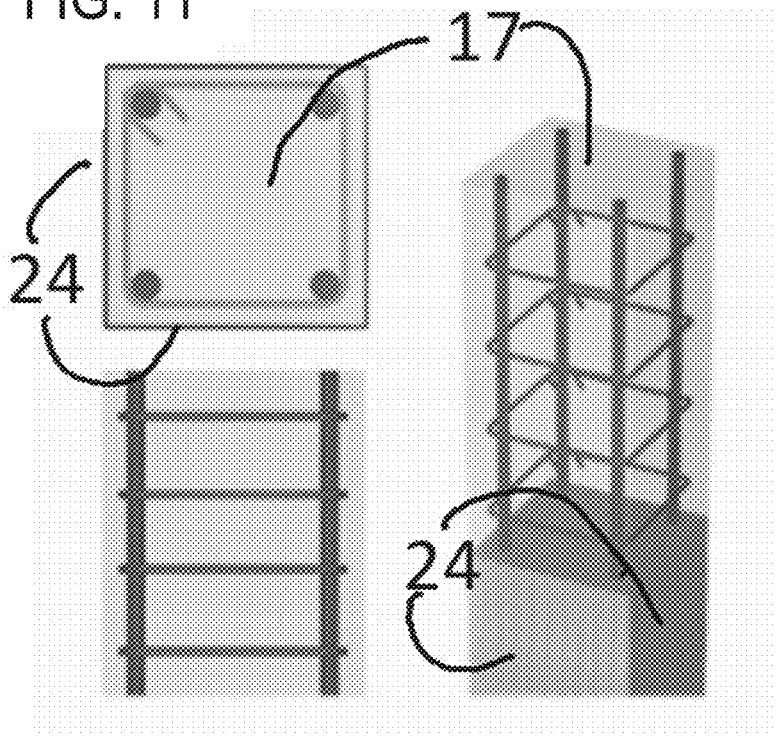
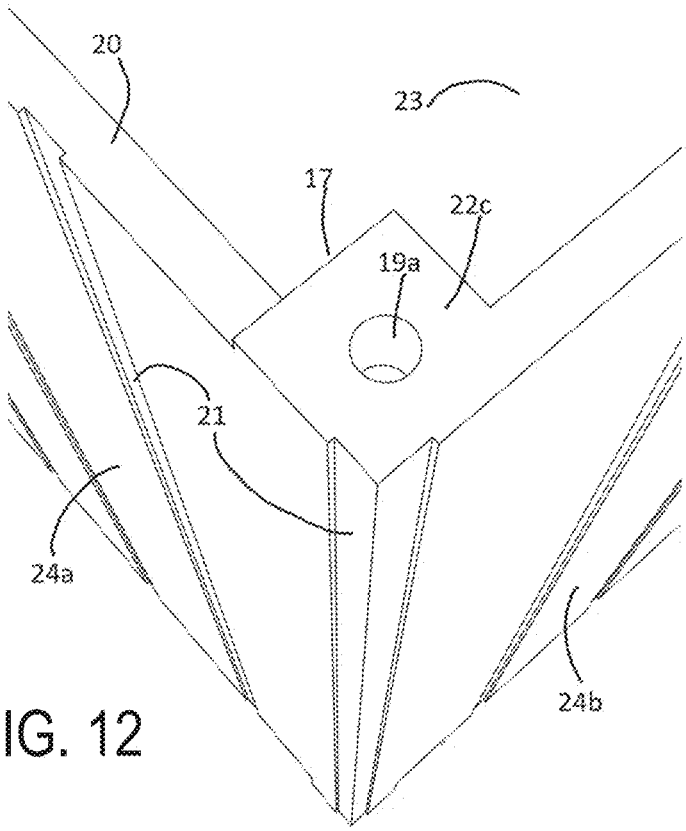
FIG. 12

MODULAR BUILDING SYSTEM AND METHOD

CROSS-REFERENCE TO RELATED APPLICATIONS

This application claims the benefit of U.S. Provisional Application No. 62/858,683, filed on Jun. 7, 2019, the entirety of which is incorporated herein by reference.

FIELD

The present disclosure relates generally to modular building systems and methods.

BACKGROUND

Modular building systems for temporary use are widely available, including so-called "pop-up" retail stores made from shipping containers, or mobile trailers towed to a location and temporarily set up on blocks for relatively short durations of time. While suitable for applications where the intended duration of use is weeks or months, these modular building systems are often not suitable for long-term applications that may last years or decades unless costly continuous maintenance take place. These prior art building systems meant for temporary use begin to suffer from deterioration including rusting, water damage, infestation, rot, and the lack of a solid foundation may cause the modular buildings to become unstable, particularly when the modules are stacked vertically to create two stories or more.

Therefore, what is needed is an improved modular building system and method that addresses at least some of the limitations of the prior art, so as to be suitable for longer term applications, that includes a more sustainable production and construction method, highly efficient energy consumption and loss, faster rate of production and assembly for much needed housing, offices, clinics, or commercial structures.

SUMMARY

The present disclosure describes a modular building system and method adapted to achieve a more efficient, durable, and longer-term modular building solution that can resist adverse weather conditions, natural disasters, and common building material degradation for years or decades, and can be built on remote sites that may otherwise be cost prohibitive to build permanent structures using more conventional building methods.

In order to achieve a product that can be most widely utilized and accessible for all markets around the world, concrete as a material can accomplish that goal. As a product, concrete is very flexible in terms of its ability to take on many different shapes, but due to its hardening characteristics concrete can be very unforgiving. Therefore, utilizing a mold and a monolithic forming method can optimize utilization of concrete materials.

In an embodiment, concrete is poured into a mold which establishes the location of predetermined openings such as doors or windows, and which strengthen such openings with steel reinforced bars. Steel reinforcement is also provide in walls and vertical columns formed in the mold.

After the concrete is cured and form panels are removed, the modular building unit includes legs or columns extending below the floor which provide connection points to another modular unit below. The modular building unit also provides circulation between stacked units, or between a modular building unit and a prepared slab on grade foundation.

In an embodiment, these contact points form open hollowed cylinders adapted to receive metal dowels which can secure the modular building unit from horizontal and vertical movement. The contact points may be integrated into a column structure which align vertically through the modular building unit and any stacked units above or below. These columns will therefore carry and transfer the vertical load through multilevel structures. These columns form a robust, reinforced part of the wall and corner structure through thicker concrete, and vertical and horizontal reinforced steel bars that reinforce the modular building unit's floors and walls.

In another embodiment, the floor and walls of a modular building structure is formed from reinforced concrete which is structurally designed to span a specified length or width, and also bear compressive loads of multilevel structures.

In another embodiment, on the top of walls formed in a modular building structure, there are preformed indentations adapted to carry a structurally designed F-ledge which will be positioned and fastened to the top of the wall. This F-ledge is configured to carry and disperse weight from above, and support a joist system. This will allow for greater spans, and larger live and dead loads from the above unit or structure.

In another embodiment, the exterior of the wall includes preformed vertical indentations laid out for installation of strapping. These vertical indentations may be used for drainage, with or without the application of strapping, and also allow for flexibility of installation of various cladding, while maintaining a proactive envelope designed for various climates.

In another embodiment, the modular building unit may incorporate lifting points that are pre-formed in the walls. These lifting points may comprise metal components surrounded in concrete but flush with the wall so that a secondary external component can be inserted and secured before any lifting occurs. The secondary component can be removed from the exterior before the installation of cladding, or the abutment of an adjoining concrete modular unit. Furthermore, during the installation and placement of a modular building unit, the secondary component can be installed on the inside of the concrete modular unit to allow for a safer and more accurate execution. Furthermore, if individual modular units are desired to be relocated, the secondary external component can be reattached and secured for future relocation.

In another embodiment, the modular building system comprises of a modular unit that is formed into a unitary (monolithic steel reinforced modular) building structure that may be interconnected laterally or vertically to form two or more floors. After the modular unit is produced it may be formed, for example, into a square or rectangular pattern using multiple units to create a solid foundation for stacking further modular units on top of one another. This is made possible by the walls that have integrated support columns to carry and transfer weight, and are securely fastened together using interconnected system of vertical and horizontal fasteners. With the units securely fastened to one another in a uniformed fashion, this allows for various utilities (e.g. electrical, water, heating & ventilation) to be installed with easy between adjacent and vertically stacked modules. The modular units are further adapted to be reinforced structurally by being placed on a solid foundation (e.g. concrete slab or a slab with intergraded footing/piles poured into the ground), and reinforced laterally and vertically using a joist system and metal brackets. The joist systems are installed between the modular unit floors giving support to the above floors, while being fastened to the metal brackets that fit on top of the lower modular unit walls giving additional strength to the walls, and joining the bottom and top unit together to form a singular building structure.

In another embodiment, the modular units are built with unitarian structurally reinforced walls, columns, and floor. The walls are easily reconfigured with the unitarian steel structure to include apertures for windows and doors, or to make openings to adjacent modular units to readily increase space on any level of a multi-unit building structure.

In another embodiment, the preformed modular units and building components are designed to have an extremely low environmental impact through minimal waste by-product during manufacturing and when assembling at desired location through its modular system.

Advantageously, by creating preformed modular units with an integral or monolithic building structure that are readily interconnected and stackable, the modular building system and method of the present invention provides an energy efficient and durable structure that is manufactured in a process that is highly environmentally cognizant. This modular building system is a cost effective building solution for many applications, including affordable and sustainable housing (e.g. single family, row housing, and multi-family), schools, office buildings, or the like, in virtually any location—particularly in remote areas with limited resources or access, where it would otherwise be cost prohibitive to build permanent, multi-storey units using more conventional building methods and materials.

BRIEF DESCRIPTION OF THE DRAWINGS

FIG. 11 shows an illustrative configuration for reinforced steel used within the columns and column extensions.

FIG. 12 shows a top view of a modular unit's corner column and the indentation for the metal member in accordance with an embodiment.

DETAILED DESCRIPTION

Figure 1:
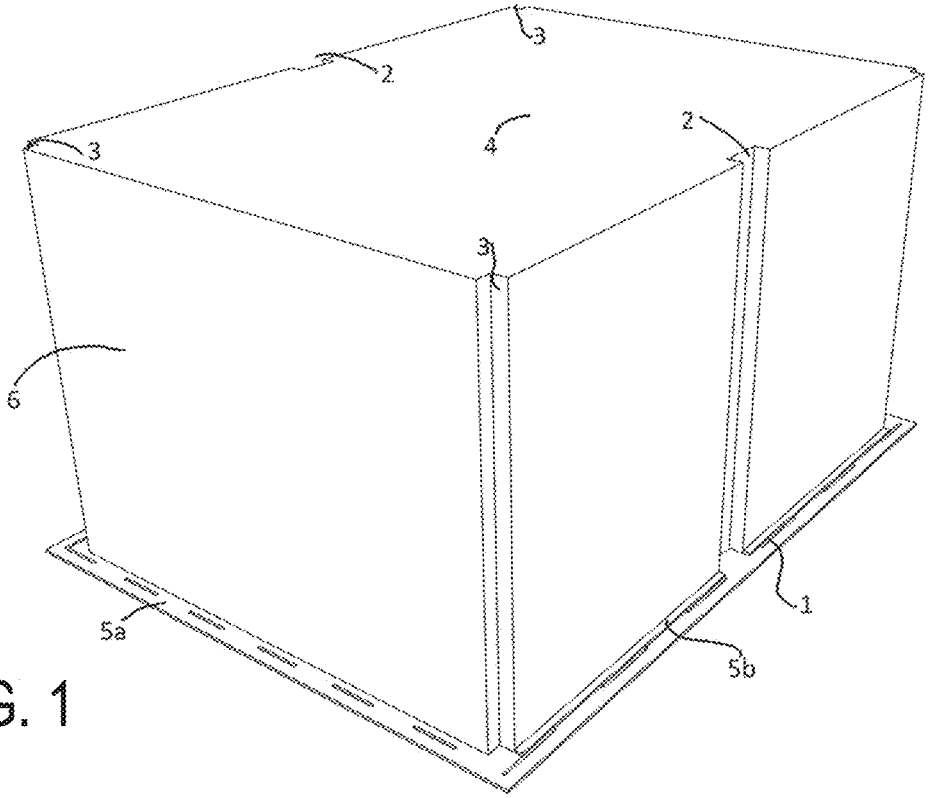
FIG. 1 shows an illustrative mold for forming a monolithic reinforced concrete modular unit in accordance with an embodiment.

As noted above, the present disclosure describes a modular building system and method adapted to achieve a more efficient and durable modular building solution.

Speed of construction, durability, cost, skilled labour, availability, and sustainability plagues the housing market no matter if it is multi-family to low income, with further complication when the economy is unstable in more vulnerable countries. Modular housing has been a solution for decades, and has been effective to produce quick housing at various price points depending on the needs, environment, and readily available materials. Furthermore, by producing these modular units in a factory can reduce the waste component, but this would depend on the end product and the sophistication of the plant producing the units.

The second part to the common modular unit is that it must be delivered to the site and erected, either completely or with protection to insure there is no water damage if rain occurs during construction. The reason being that the materials most commonly used are soft materials they require dry temperature controlled environments. This is a further reason why these types of units cannot be stockpiled, or if they were, the cost would cause the end product to be higher to maintain a sustainable profit. Therefore, in a world of extreme variables and the need for adaptability, the common modular unit and construction must be taken at the completion of production to avoid cost overruns of storage or duplicating production and scheduling effects.

Common modular unit construction and assembly has another flaw that is recognized in a multi family, single family, or other methods of modular construction, and that is of areas of opening and joints of where units or materials come together. This waterproofing and envelope deficiency can cause mould and rot that can create an environment that can be harmful for individuals that become in contact with the partials. This is a common problem with soft materials found in common modular units, and depending on the due diligence of the inhabitants this can cause an increased health risk. Furthermore, the compromised envelope can also promote structural integrity issues, which has the potential to cause physical health risks. This can be avoided if proper construction and code techniques are utilized, but if avoided or in areas with lack of materials or skill trades this is a recurring issue.

As sustainability becomes more prevalent in governmental directives from around the world, three main aspects are focused upon to achieve the most basic of goals, which include sourcing of materials, waste of materials during production, and efficiency of the end product. As stated above, the common modular unit process can achieve these objectives under ideal conditions being climate, economic status in which they are being produced, conditions of the facility, and so forth. Unfortunately, these variables do not serve a majority of the world's population that are in need of efficient housing and have minimal impact on the environment pre and post construction. As a result, concrete components to form housing units can serve a huge advantage due to the readily available product globally, minimizing waste, and further sustainability through virtually zero decomposition of concrete and energy efficiency.

The most common method of when using concrete for multi or single family is through the process of forming, which is a tried and tested approach and structurally sound. Another advantage of concrete forming is the flexibility to form objects or walls that are not typical or unique for structural requirements or architectural detail. These methods limitations don't come in the form of the product but rather the process of getting to the product. Concrete forming requires skilled consultants to design the appropriate details for the project, and then skilled trades to perform the work in order to achieve the desired end product. These skilled trades depending on the proficient nature and talent of the work force will determine quality and speed, which unfortunately can be a trade-off. As the form work continues on site waste and uncontrolled chemicals are a huge by-product of the work, as well as the unpredictable working conditions caused by weather, field conditions, and general dynamic movement around the site. When the concrete has cured over the long designated time depending on the structure, further waste is produced during the stripping process of the form walls or the removal of form work that creates the floor. These variables are critical to understand, because they can cause health risks for the works and also potential errors in the end product which is now solidified in concrete. As stated above, this method is still widely used today and proves to be effective in achieving strength and efficiency, but still contains many variables and is not accessible in the fight for housing for the population that requires all the benefits concrete has to offer.

As the benefits of modular concrete components have been realized in the marketplace, various methodologies have emerged with the focus being speed through efficiency and sustainability through the reusing of materials. To achieve the proposed goal, the majority of these methods will be performing the work on site, which still encounters working conditions variables, but speed is increased through the use of prefabricated paneling and then decreased by the reuses of materials due to the curing time. Furthermore, with this methodology each new assembly will create a cold joint that requires further attention and the potential of issues like water penetration and others. To combat the speed variable, more prefabricated panels can be used, or another methodology would be to perform the work off-site and assemble onsite. This method, also referred to as tilt-up, is widely utilized in commercial uses, but further issues with joints which is not ideal for human habitation.

In response to the current methodologies, but maintaining the benefit of concrete construction in a modular form, this presented design will utilize a modular monolithic cubic technology. That will result in a sustainable product using a consistent mold or various sized molds that the outer dimensions are divisible to adjacent units. Utilizing this methodology will emerge a product that will require minimal skilled labour or large workforce. This allows for efficiency and accuracy with a high performance design to achieve optimal habitable environment and durability. To produce this product, it is accomplished in a controlled setting to decrease the variables and produce a product at optimal efficiency until the modular units are ready to be delivered and assembled onsite.

In order to achieve a product that can be most widely utilized and accessible for all markets around the world, concrete as a material can accomplish that goal. As a product, it is very flexible in terms of its ability to take on many different shapes, but due to its hardening capabilities concrete can be very unforgiving, therefore, utilizing a mold and a monolithic method can ensure the optimum utilization of this material can be met.

As the concrete is poured into the mold that contains a unitarian reinforced steel structure that consists of the walls, floor, columns, and column extensions the location of the openings are predetermined. This is further strengthened with steel reinforced bar around the opening and apertures. After the concrete is cured and the form panels are removed, the modular monolithic unit will consist of extended columns past to floor which will give connections points to the modular unit below, as well as give circulation between the modular units or a prepared slab on grade foundation.

These contact points will also consist of formed open hollowed cylinders so that a metal dowel can secure the unit from horizontal and vertical movement. The contact points will be integrated into the column structure that will carry vertically through the modular unit. This will act to carry and transfer the load from any above structure. These are a robust part of the wall and corner structure through thicker concrete and vertical and horizontal reinforced steel bar that forms monolithically to the floor and the walls.

As an extension of the columns, the floor and wall will be reinforced concrete that are structurally designed in a unitarian fashion to span and take the compressive loads. On top of the walls will be a preformed indentation that will carry a structurally designed F-ledge, which will sit and be fastened to the top of the wall. The functionality of this F-ledge is to prevent torsion of the wall, carry and disperse weight from above, and support a designed joist system. This system will allow for greater spans and larger live and dead loads from the above unit or structure.

The exterior of the wall will consist of preformed vertical indentations laid out for the installation of strapping. These are used for drainage with or without the application of the strapping, and allows for flexibility of the installation of various cladding, while maintaining a proactive envelope designed for various climates. The concrete modular units will also incorporate a lifting system that will be pre-formed in the walls. These metal components will be surrounded in concrete but flush with the outer and inner wall, so that a secondary external component can be inserted and secured before the act of lifting occurs. The secondary component will be removed from the exterior before the installation of cladding, or the abutment of an adjoining concrete modular unit. Furthermore, during the installation and placement of the concrete modular unit, the secondary component can be installed on the inside of the concrete modular unit to allow for a safer and more accurate execution.

Thus, in an aspect, the present disclosure relates to a modular building system and method adapted to achieve a more efficient, durable, and longer-term modular building solution that can survive adverse destructive and non-destructive weather conditions, resists the degradation and rotting causing mold of standard building materials, promote a non-combustible habitat, and forgo infestations causing physical damage. The modular building system and method is designed with a service life that may extend to years or even decades, and is especially suitable for remote sites or locations where it may be cost prohibitive to build permanent or temporary structures using more conventional building methods.

In an embodiment, the modular building system and method utilizes a combination of concrete and metal to create a modular component that can be adapted into many different configurations. These materials are integrated together in a form to create a modular building system which gives the modular building units a high degree of strength, energy efficiency, and uniformity for a precise fit for stacking. This modular building technique provides the ability to produce, deliver, and construct buildings on site at a faster pace, as well as providing accurate cost estimates for completing a building project.

In another embodiment, the modular building units may be made in different sizes (wall length and height) while allowing stacking and interconnectivity between modules, with a uniform quality, compatibility, and strength through a staggered design.

An illustrative embodiment will now be described with reference to the figures.

Making reference to the drawings and the specific details that are numbered in the figures in order to describe the relationship of each location in order to produce the concrete monolithic modular unit. Furthermore, using those same specifics, a description will be formed on how each unit can function as a multi-unit construction assemble through the reliance on each unit for a strong and efficient formation.

FIG. 1 shows a plan view at an angle to capture the details on the side of the mold base. These details will be the bases for the concrete monolithic modular unit. This includes the base plate 5 that supports the form panels, the F-bracket 28 indentation 5*b*, and the slots 1 around the base plate that accept the form panels. The vertical support columns are molded through the indentation found in the center 2 of the base mold 4 and at the corners 3.

Figure 2:
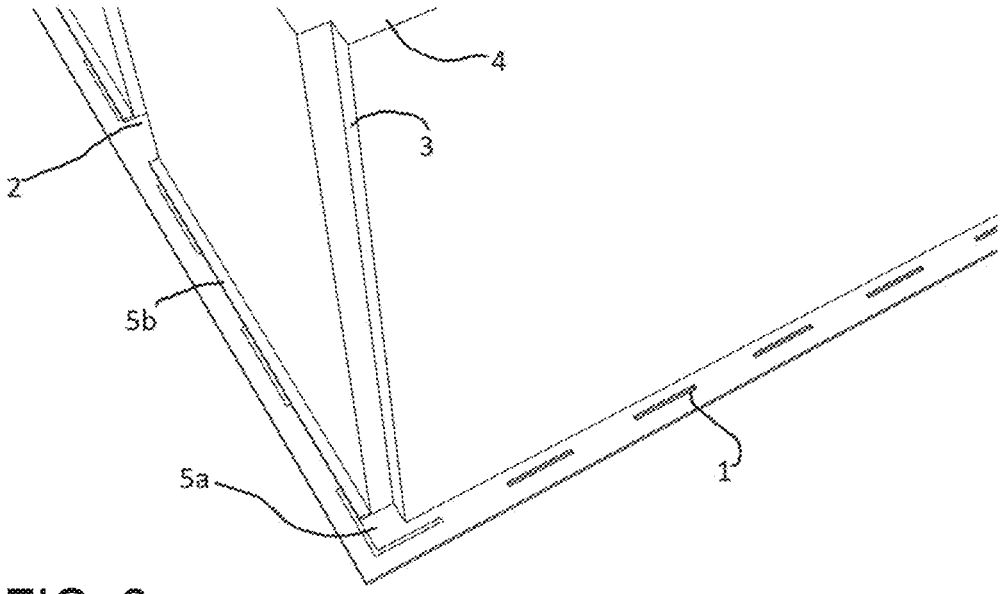
FIG. 2 shows a portion of the mold of FIG. 1 for forming a column that integrates into the walls and floor to obtain a monolithic design.

FIG. 2 describes the similar detail as FIG. 1, but at an angle that illustrates the corner column form 3 and how once the concrete is poured to form the column 17 and the wall 25*b*, 25*a* it creates the monolithic structure, which included the top of will indentation 5*b*.

Figure 3A:
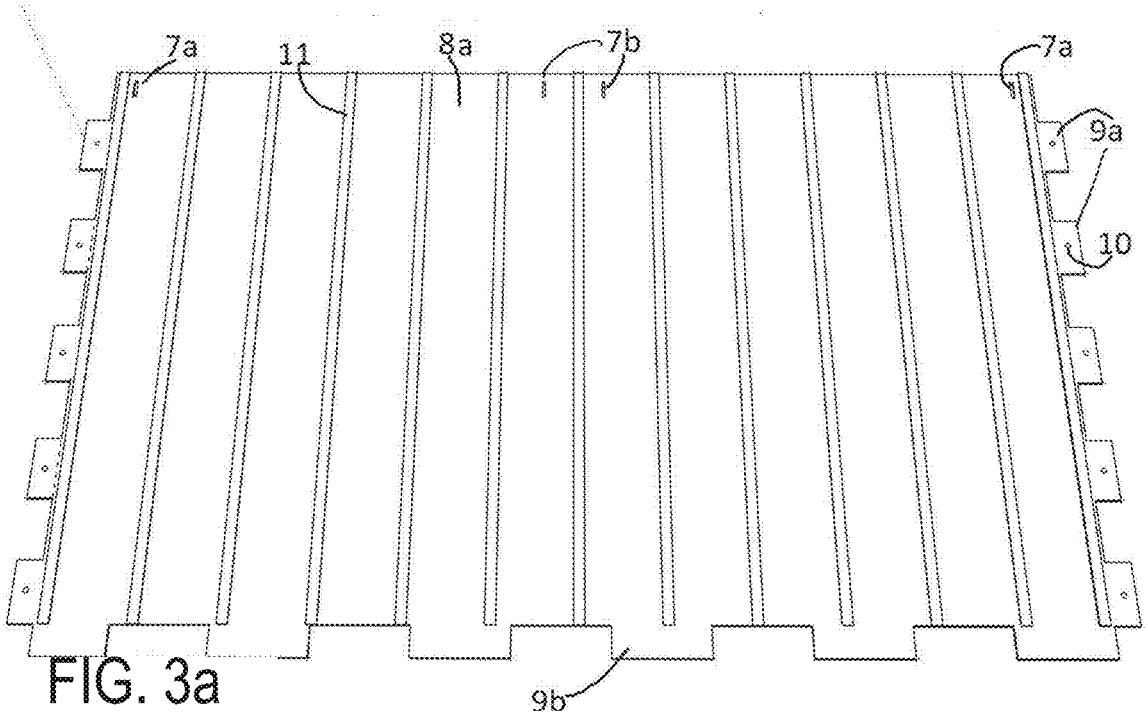
FIG. 3*a* shows a first form panel which includes forming strips in accordance with an embodiment.

FIG. 3*a* is showing the inside of a single form panel 8*a* for the longer portions of the modular unit. This panel is similar in nature to the panels in FIG. 3*b*, except for the size to accommodate the longer portion of the unit and the slots found at the top center of the panel 7*b*. Those slots will be used to accept brackets 12*b* that mold the center column extension 12*a* depicted in FIG. 4*a*. 7*a* indicates slots that accept one half of the brackets 14*a* that form the corner extensions 13. Detail 9*a* are the interconnections used to form the corner of the modular unit, and will interlock with the adjoining right angle form panel. Similar in design to the interconnect extensions 9*a*, will be the extensions 9*c* found at the bottom of the form panel 9*b*, which will be vertically slotted into the base plate 5 of the mold into the predetermined slots 1.

Figure 3B:
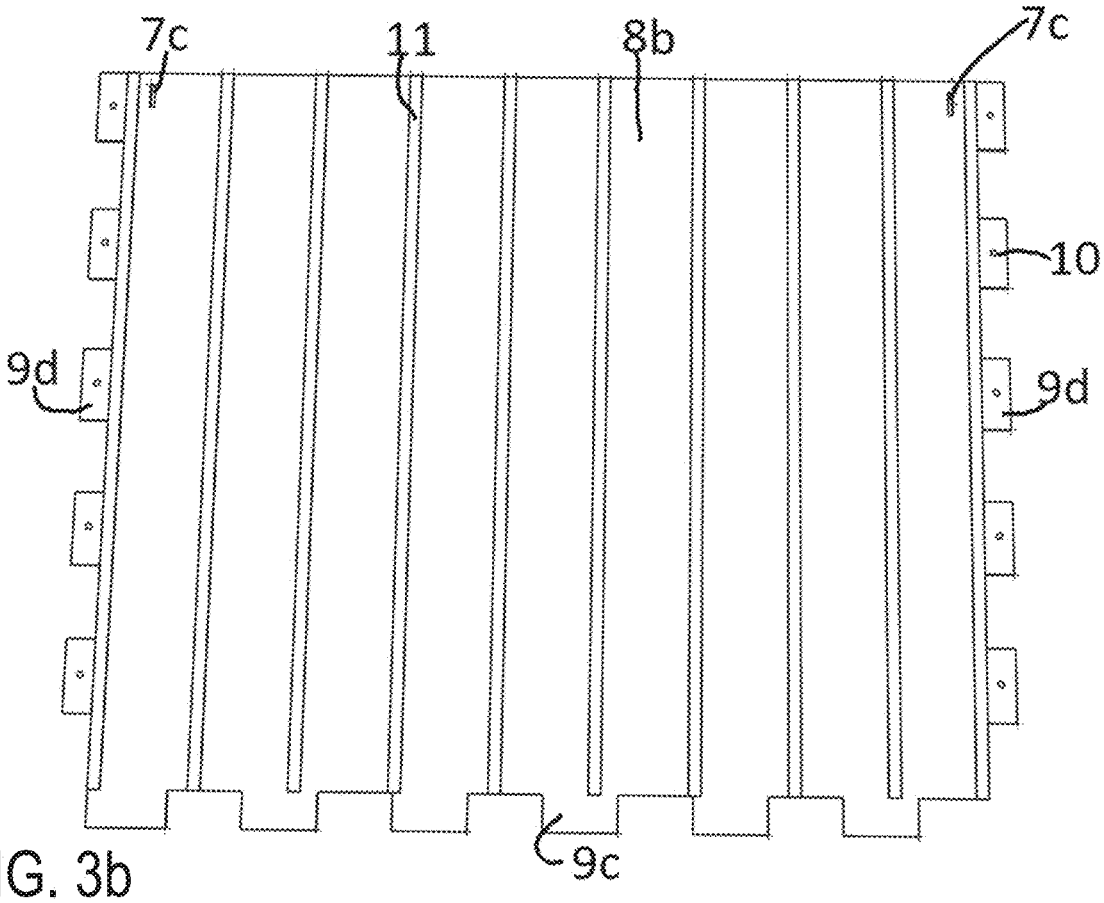
FIG. 3*b* is the second form panel configured to integrate with the first panel.

FIG. 3*b* is depicting a smaller form panel 8*b* that would be used to form a wall designated to its dimensions. Similar in nature to the form panel found in FIG. 3*a* 8*a*, this panel 8*b* would form a single wall. Using the same methodology as the larger form panel 8*a*, the smaller panel 8*b* would slot vertically using the extensions 9*c* found at the bottom of the panel. Then erected to allow the interconnected extensions 9*d* to interlock with the similar in design but antithesis in location 9*a* similar to the panel found on FIG. 3*a*. Once in place, the slots found at either corner 7*c* can accept the other half 14*b* of a bracket 13 that creates a corner column extension.

Figure 3C:
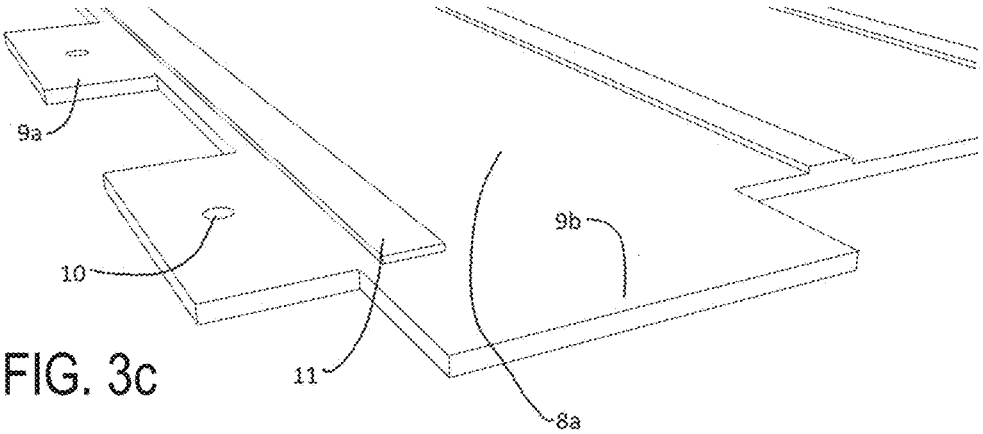
FIG. 3*c* show a close-up view of the form panels of FIGS. 3*a* and 3*b*.

FIG. 3*c* shows the bottom of a form panel 8*a* or 8*b* in a more detailed perspective. From this angle will show the profile of the vertical stripes 11 on the form panel 8*a* or 8*b* which will create an indentation for the potential insert of vertical strapping. Furthermore, this angle will indicate the relationship between the vertical strip 11 thickness and the thickness of the form panel.

Figure 4A:
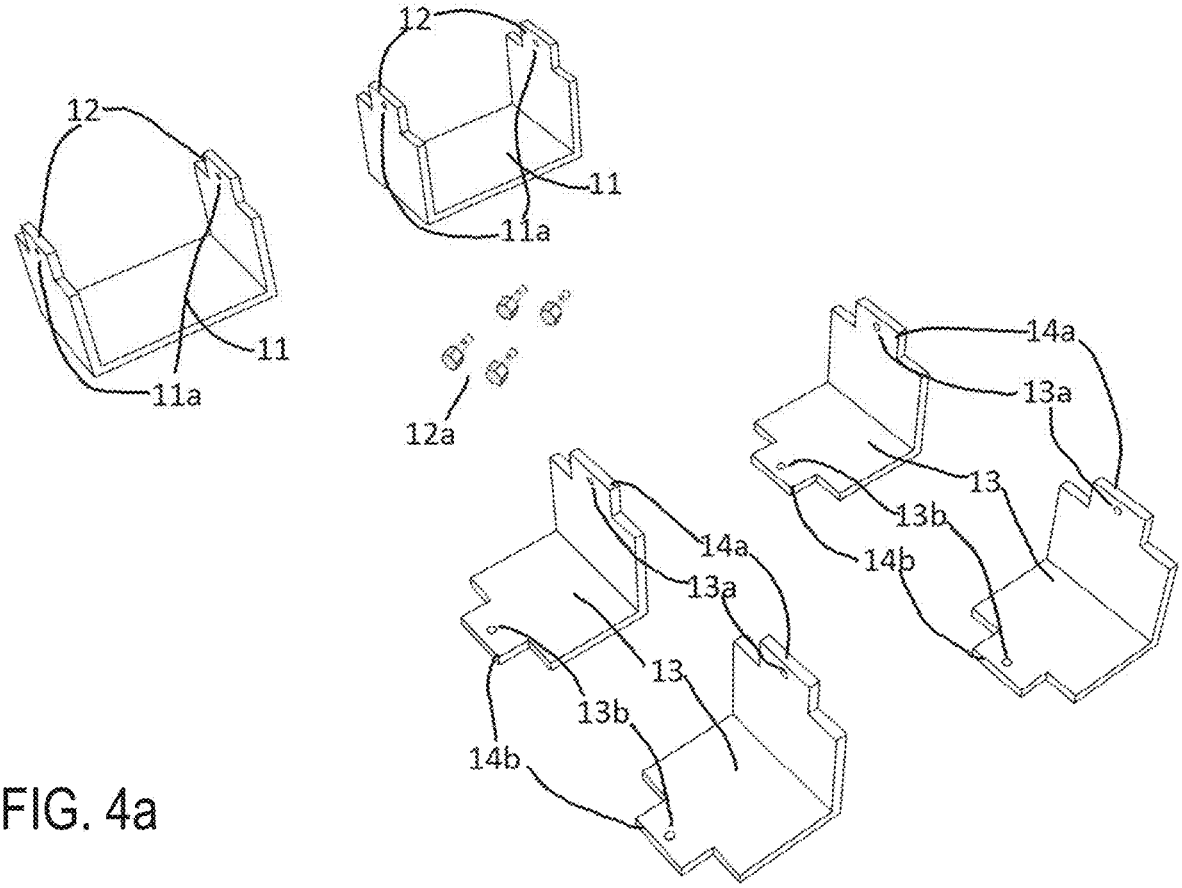
FIG. 4*a* are the molds for forming column extensions in accordance with an embodiment.

FIG. 4*a* lays out the two different brackets 13 and 11 that will create column extensions 22*a* and 22*b* below the concrete monolithic modular unit. These brackets 13 and 11 have been designed to slide into the predetermined slots 7*a*, 7*b*, and 7*c* found on the form panel 8*a* and 8*b*. The functionality is the same, but they are designed differently due to the location, the above load that it will carry, and configuration of below modular units if desired. The corner bracket 13 is designed to slot 14*a* and 14*b* into two adjacent form panels and secured in place using a pin system 12*a* into the designated holes 13*a* and 13*b*. While the center bracket 11 will be inserted into the same panel 8*a* using the extension 12 and secured using the pin system 12*a* into the designated holed 11*a*.

Figure 4B:
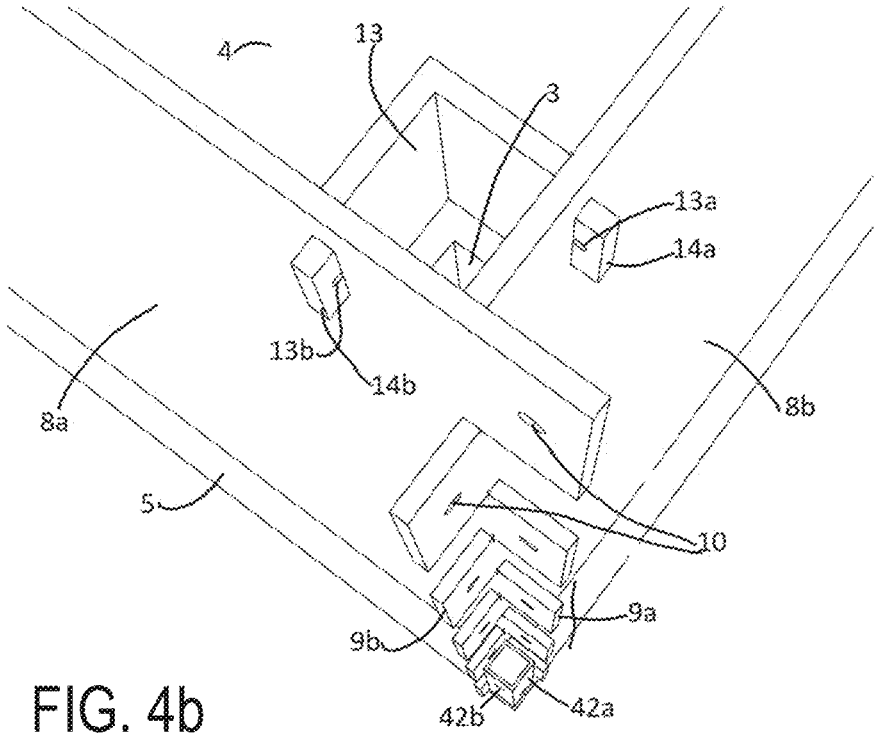
FIG. 4*b* shows the first and second form panels of FIG. 3*a* and FIG. 3*b* joining together at a corner of the mold.

FIG. 4*b* depicts two form panels, using any combination of panel, to create a secured corner detail. This shows the interconnected relationship between the two panels ends 9*a* and 9*b*, and how they are secured together using a vertical bar 42*a*. To note, this bar is shorter than recommended, and FIG. 4*b* was showing the intent of the vertical bar. Also being shown is how the corner bracket 13 slots into two locations 7*a* and 7*c* on two different panels 8*a* and 8*b*, and secured using the pin system 12*a* into the holes 13*a* and 13*b* on the respective bracket.

Figure 4C:
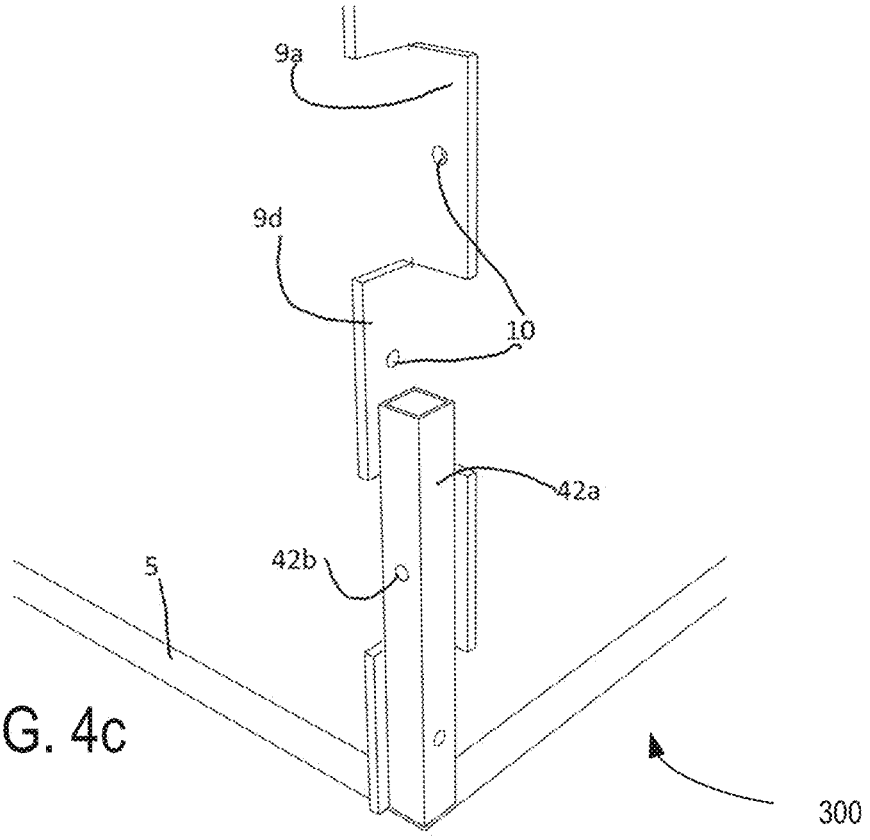
FIG. 4*c* another view of the first and second form panels of FIG. 4*b*.

FIG. 4*c* is showing the bottom portion of the relationship between two form panels, the base mold 4 and base plate 5, and how the vertical bar 42*a*. As noted above, the vertical bar depicted in FIG. 4*c* is shorter than recommended, but is drawn in a way to show functionality between two form panels. The vertical bar 42*a* is secured in place using the bolt system 42*c* that slides through the holes 42*b* and the adjacent hole 10 on the form panel, and then the bolt system 42*c* is secured using a pin system 42*d*. The bolt 42*c* and pin 42*d* system for the vertical bar 42*a* will be depicted in FIG. 4*d*.

Figure 4D:
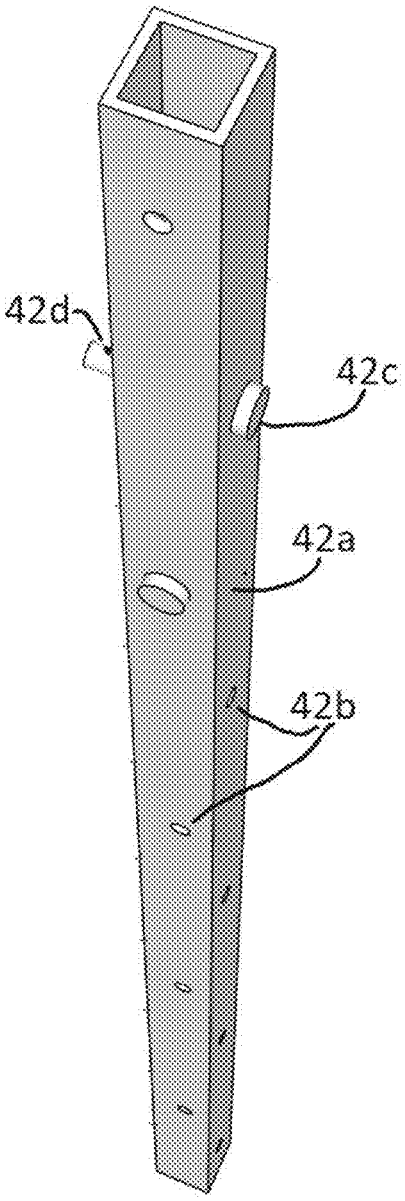
FIG. 4*d* shows a full length of a corner in accordance with an embodiment.

FIG. 4*d* illustrates the vertical bar 42*a* that would best suit form panels in FIG. 3*a* and FIG. 3*b*, as well as the bolt 42*c* and pin 42*d* system that secures the vertical bar 42*a* to the form panels. The vertical bar 42*a* will be the same height as the associated form panels, and will have holes 42*b* that correspond to the hole on the respective form panels 10 interconnected extensions 9*a* and 9*d*. These vertical bars 42*a* will be found at every ninety-degree junction between two form panels to prevent the panels from horizontal separation.

Figure 5:
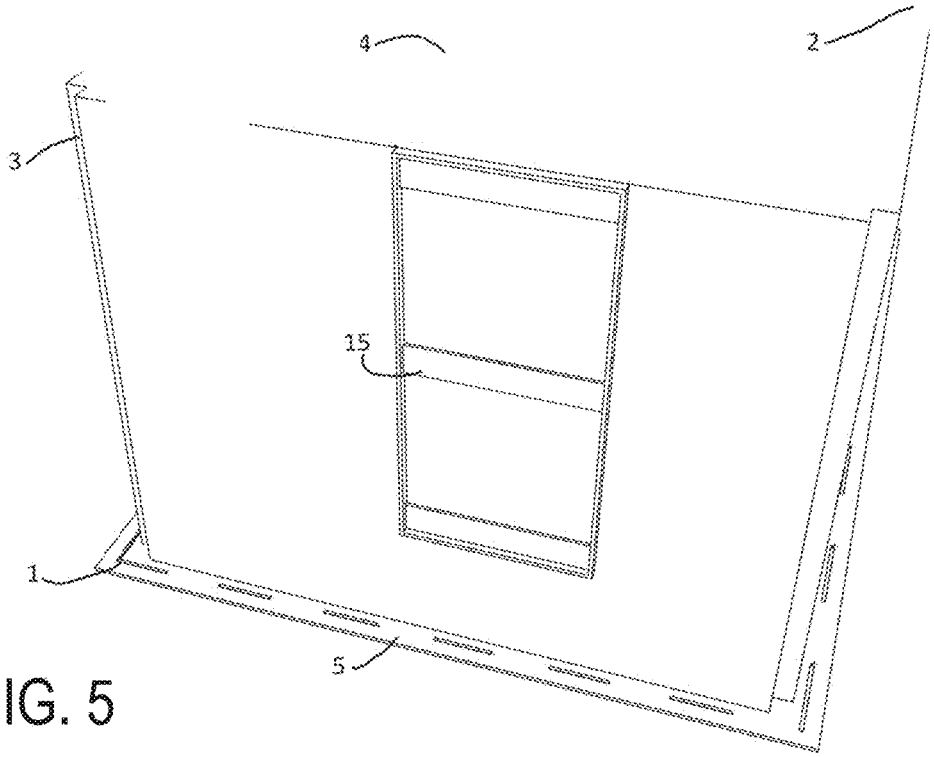
FIG. 5 shows a predetermined form for an opening such as a door.

FIG. 5 represents a designed form for a door 15 that would be attached to the face of the unit mold base 6 before the form panels 8*a* and 8*b* are assembled. This would fit tight against the form panel 8*a* and 8*b*, and once removed the opening would be precast into the concrete that would fit a specific door specification.

Figure 6:
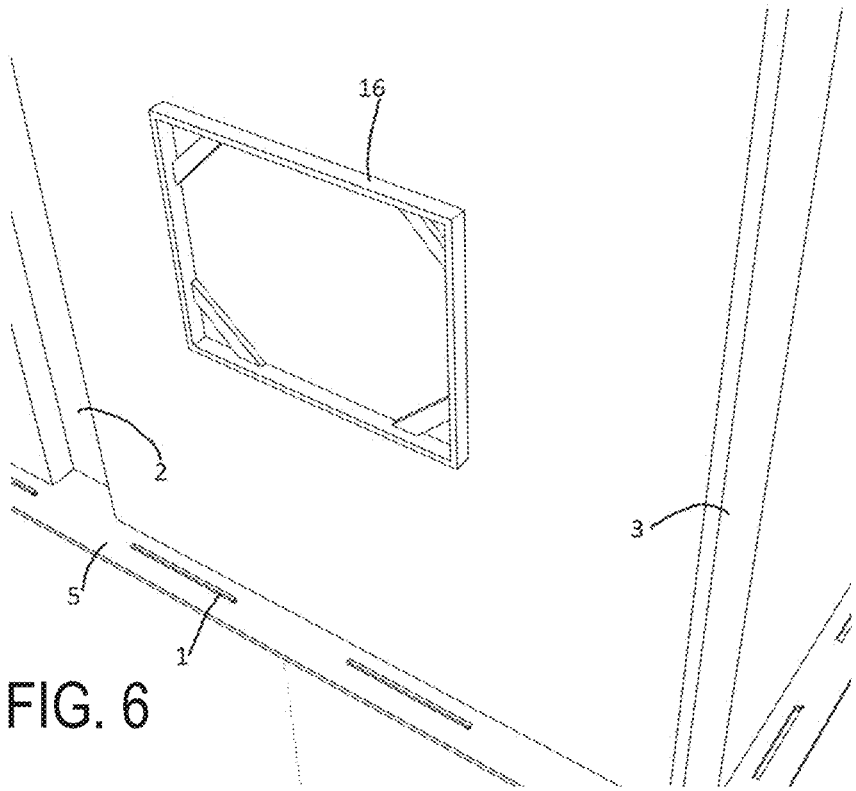
FIG. 6 shows another form for an opening such as a window.

FIG. 6 is a similar representation as the figure depicted in FIG. 5, but this shows a window form 16 that will create a precast opening for a specific window specification. Again, similar to FIG. 5, this sizing can vary to reflect design and structural integrity outlined by its use. The window form 16 may be installed before form panels 8*a* and 8*b* are installed, which is comparable to the door form 15 installation.

Figure 7:
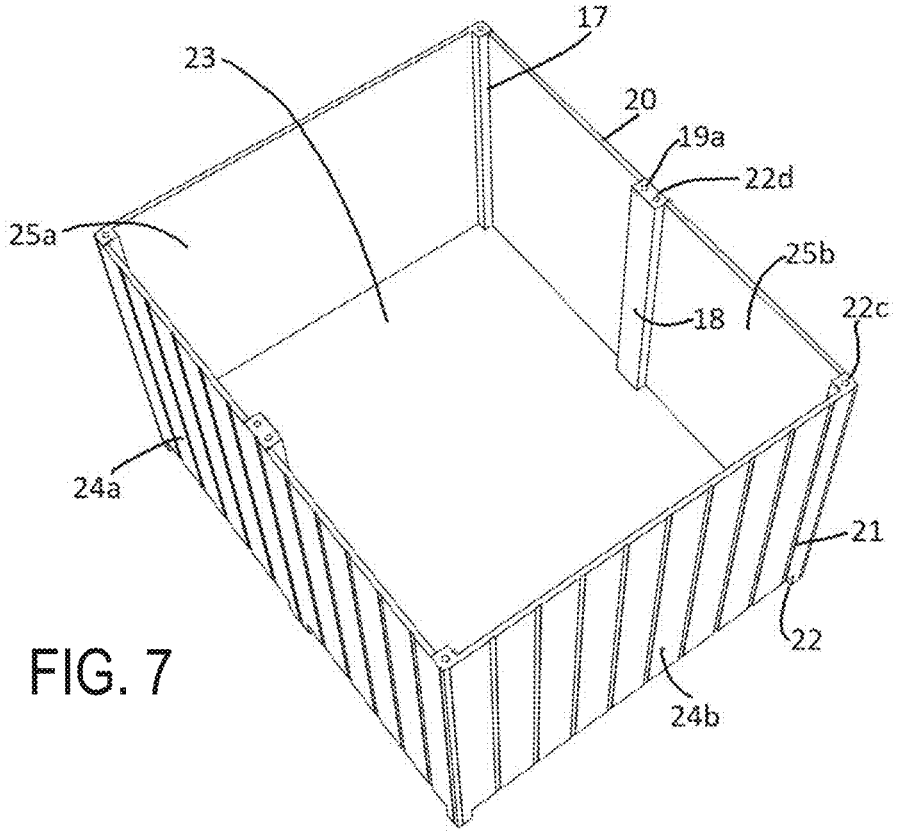
FIG. 7 shows a formed modular monolithic unit with four walls, floor, and columns in accordance with an embodiment.

FIG. 7 portrays the concrete monolithic modular unit 23 and the details at a high level, in which they will be further addressed in following figures. As indicated in the past, many combinations of modular units can be produced based on the use and specification. The concrete monolithic modular unit shown allows for two types of wall, one interior wall 25*a* with no center column 18, and another interior wall 25*b* with a center column 18.

Figure 8:
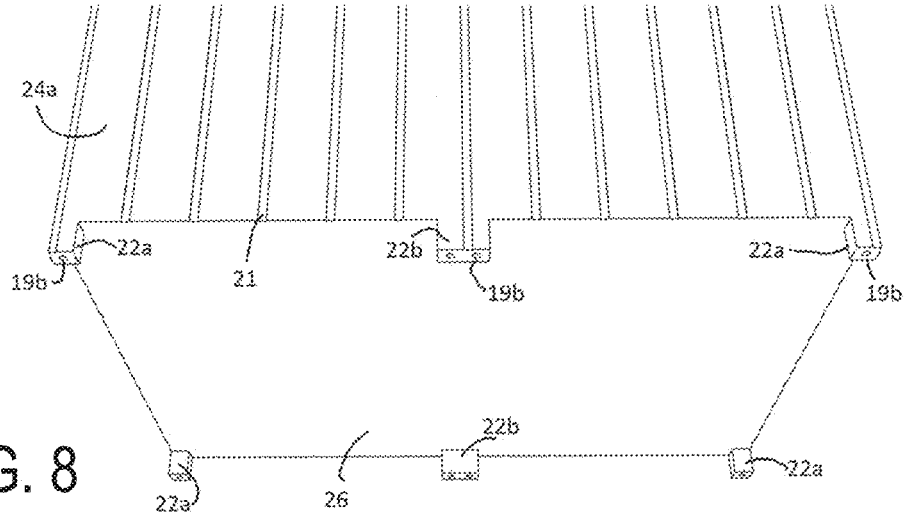
FIG. 8 shows an illustrative column extension in accordance with an embodiment.

FIG. 8 is showing the underside 26 of the modular unit and the features that allow the unit to stack on another unit or rest on a prepared surface. As an extension of the columns 22*a* and 22*b*, they create contact points and secure to other units contact point 19*a* or 19*b*, or to the prepared surface using metal members and epoxy. This reduces the vertical and horizontal movement if the 23 units or units endure a force. The different column extension 22*a* and 22*b* are designed specifically for various configuration of modular units and point loads from above. The middle column extensions 22*b* support and resists a deflection of the unit slab above, and has the ability to utilize a single point load surface 19*b* on either end for various configurations of modular units below.

Figure 9:
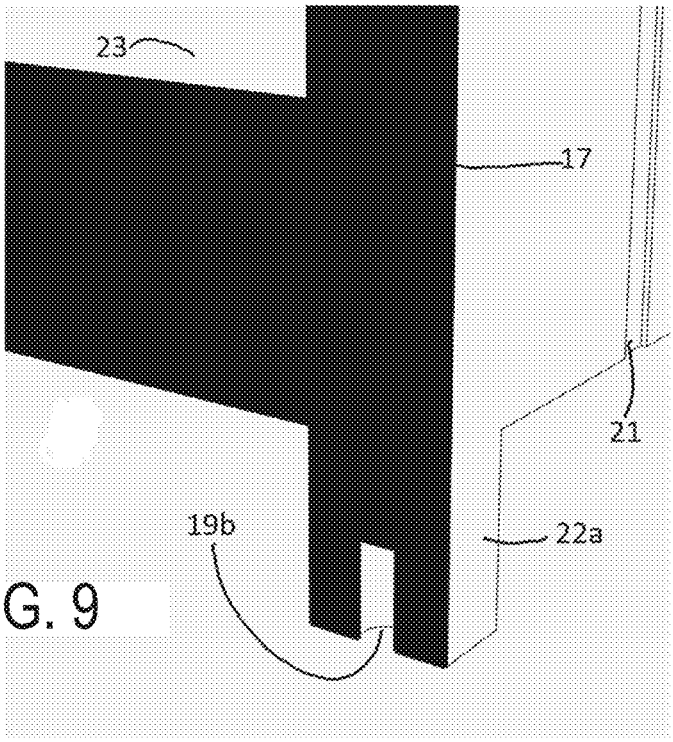
FIG. 9 shows a section of the column extension of FIG. 8 in accordance with an embodiment.

FIG. 9 is a cross section of a corner column extension 22*a* found in a concrete monolithic modular unit. This is a representation of the depth of the metal member and epoxy, as well as the monolithic concrete that solidifies the floor 23, the column 17, walls 25*a* and 25*b*, and column extension 22*a*.

Figure 10:
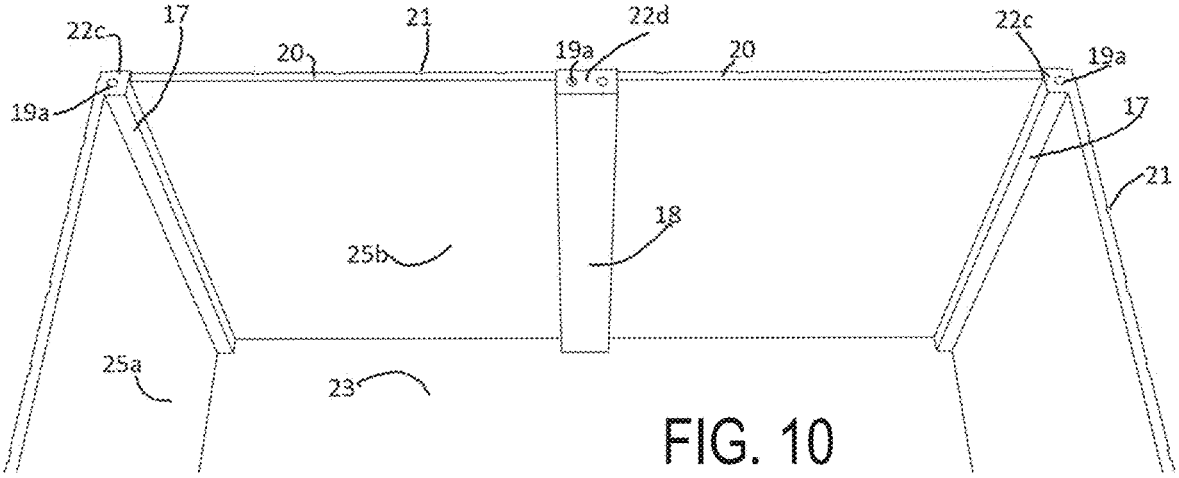
FIG. 10 shows a wall top and columns with connection locations in accordance with an embodiment.

FIG. 10 illustrates the top of the modular unit, the details that provide integrity to the functionality, and relationship to other modular units in a multi-unit situation. The two different types of column 17 and 18 are formed in the mold depicted in FIG. 1, and designed to give vertical and torsional strength to the unit through the monolithic concrete design. These columns 17 and 18 also allow for point loads from weight above, and secure to a unit above and below by the locations 19*a* that accept the metal member. The top of the wall has an indentation 20 detail that accepts a predetermined F-bracket, which will further assist in load transfer to the columns 17 and 18 and allow for contact points 30 connection points 29 for a joist or roofing system.

FIG. 11 is a plan view and section schematic of a typical reinforced steel drawing that would be incorporated into the corner columns 17. This design would allow reinforced steel to be carried from the walls 25*a* and 25*b* horizontally to be tied into the columns 17 and 18 to give further integrity to the monolithic design.

FIG. 12 shows a top down view of the corner of a concrete modular unit 17 more specifically. It details the corner column's 17 integration with the adjacent walls 25*a* and 25*b* and the indentation 19*a* on the top of the column 17 for the insertion of a metal member if needed to secure additional unit or structure above. Furthermore, FIG. 12 depicts the vertical indentation 21 detail which allows for vertical strapping around the concrete modular unit, and the detail at the corners to promote effective envelope installation.

Figure 13:
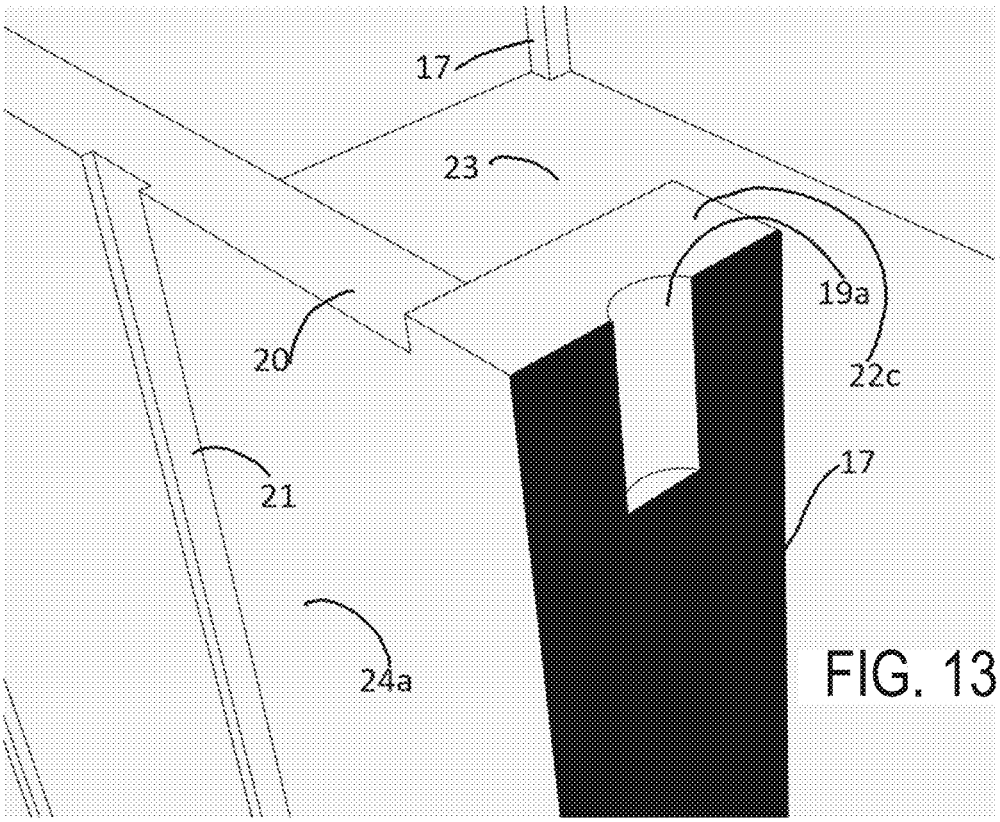
FIG. 13 shows a cross section of a column and the indentation for a metal member in accordance with an embodiment.

FIG. 13 is a cross section of a corner column 17 and the indentation 19*a* for the insertion of a metal member, as well as illustrating the monolithic concrete design between the column 17 and the adjacent wall 24. This a similar detail depicted in FIG. 9, which shows the column extension 22*a* and how the mental member would insert into the bottom 19*b* to secure a modular unit below. Therefore, these four locations 22*a* and 22*c* are closely related in design because they can pick up the same point load and transfer it vertically. In addition to the two locations 22*a* and 22*c* described above, the center column extension and surface 22*b* and 22*d* on top of the center column 18 should be acknowledged, because its design and functionality is of similar nature.

Figure 14:
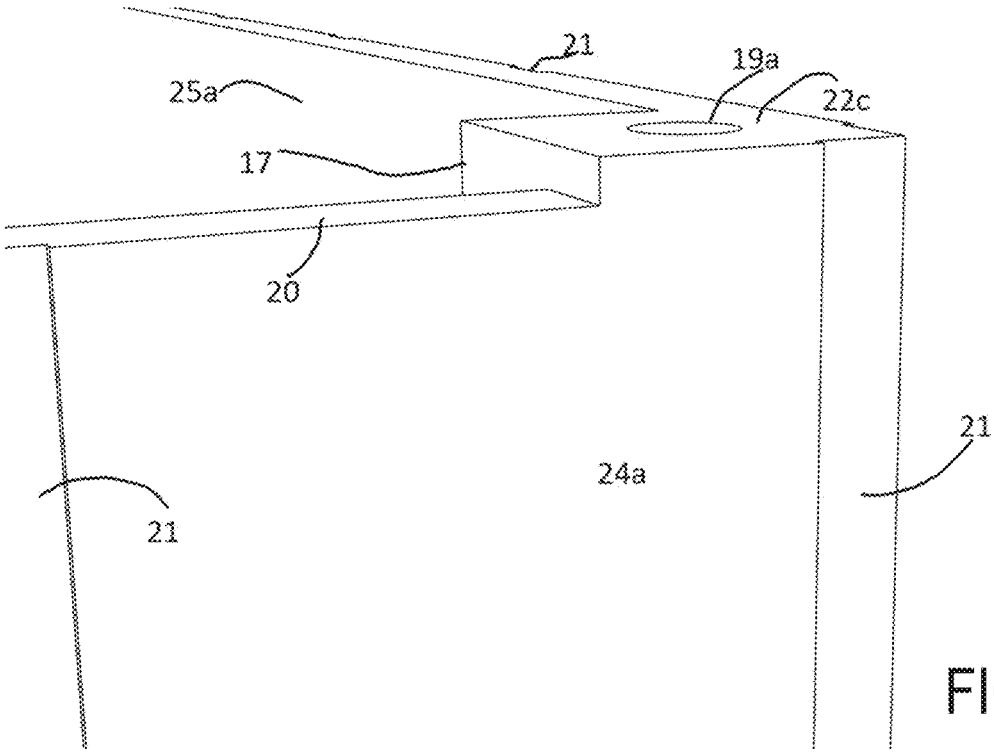
FIG. 14 shows a view of a wall top having a depression for installation of an F-bracket detailed in FIG. 16, FIG. 17, and FIG. 18.
Figure 15:
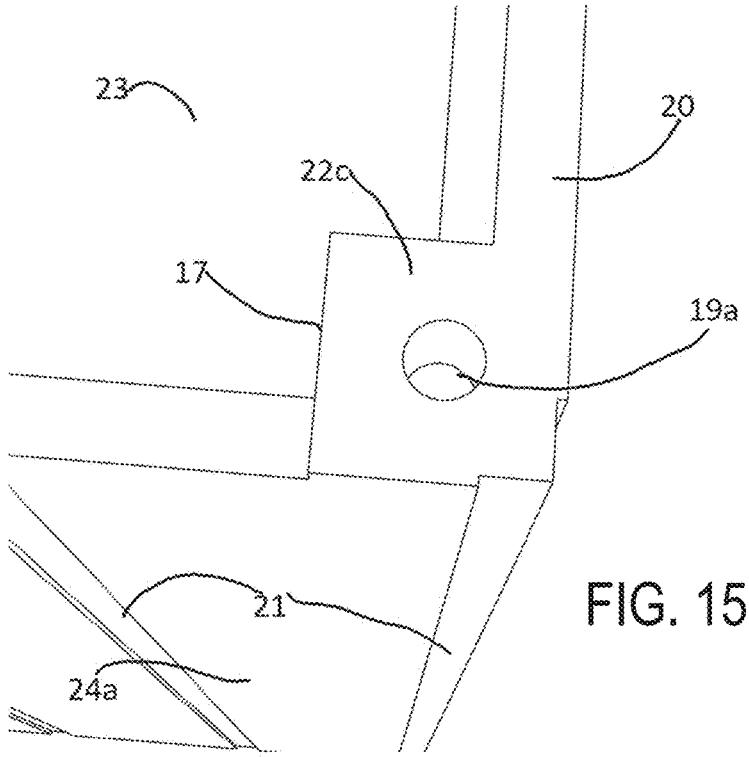
FIG. 15 shows a plan view of the F-bracket depression of FIG. 14.

FIG. 14 and FIG. 15 are primarily showing the location of the indentation 20 on the concrete modular unit for the installation of the F-bracket. The location of the indentation 20 is found between columns 17 and 18 to allow for the transfer of loads to the vertical load points, and the depth of the indentation 20 will be the same thickness 32 of the F-bracket to maintain a flush plain around the top perimeter of the concrete modular unit.

Figure 16:
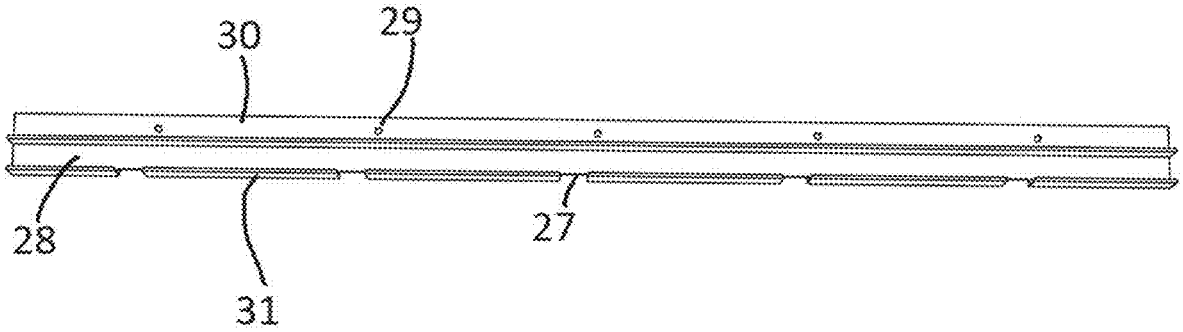
FIG. 16 shows an F-bracket in accordance with an illustrative embodiment.
Figure 17:
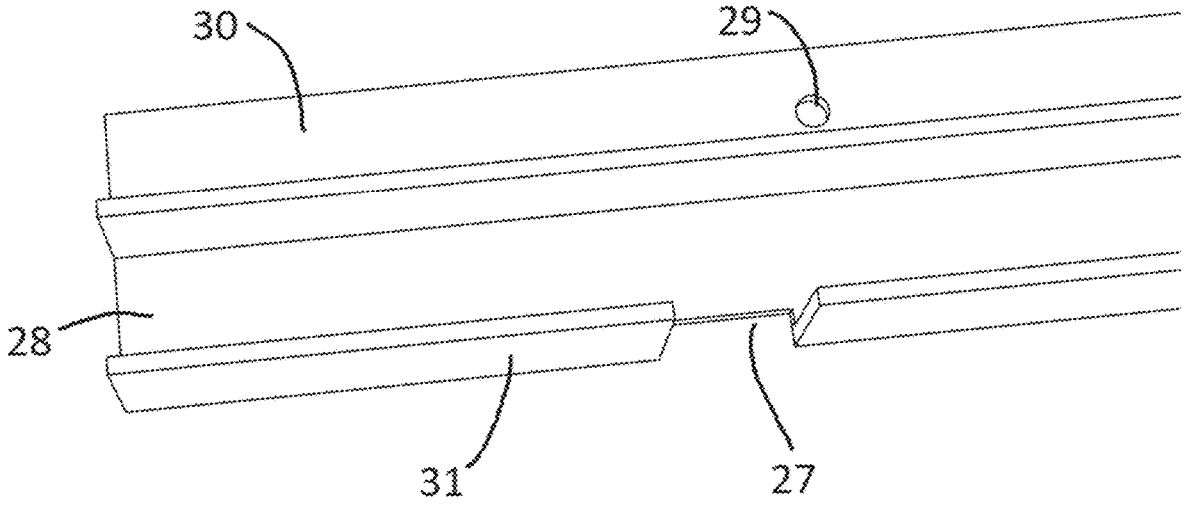
FIG. 17 shows connection points found on a portion of the F-bracket in accordance with an embodiment.

FIG. 16 shows a full length F-bracket illustration and the portion 28 that will insert into the indentation 20 on top of the concrete modular unit's wall 25*a* and 25*b*. FIG. 17 is a similar angle to FIG. 16, but with a more detailed illustration of one end of the F-bracket.

FIG. 17 shows the main element of the F-bracket, which consist of the inside portion 28 that makes contact with the indentation 20 at the top of the concrete modular unit's wall 25*a* and 25*b*; connection points 29 located on the inside horizontal flange 30 that can support joist systems, roof systems, or overhead supports; and on the exterior of the F-bracket will consist of vertical projections 31 at consistent intervals to leave an opening 27 for the vertical indentation 21 found on the exterior of the concrete modular unit 24*a* and 24*b*.

Figure 18:
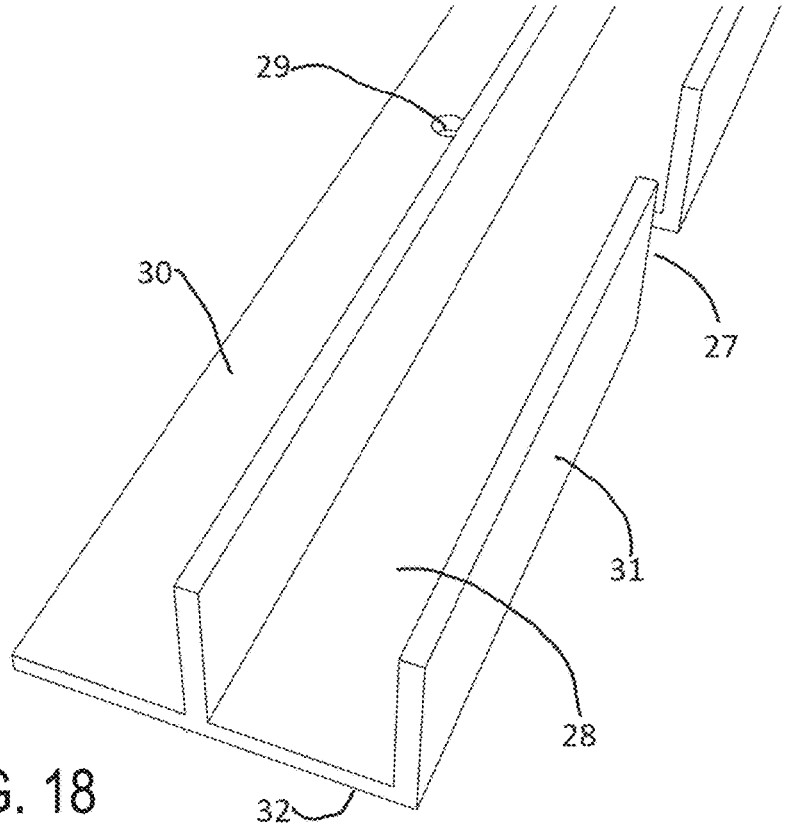
FIG. 18 shows the F-bracket of FIG. 15 in an alternate view.

FIG. 18 depicts the F-bracket details, similar to FIG. 16 and FIG. 17, but by examining the F-bracket from this angle it emphasizes the thickness of the material and the relationship it has with the indentation 20 at the top of the concrete modular units walls 25*a* and 25*b*. Furthermore, the thickness for the vertical projections 31 on the exterior of the F-bracket and the depth of the cut out 27 that takes into account the vertical indentation 21.

Figure 19:
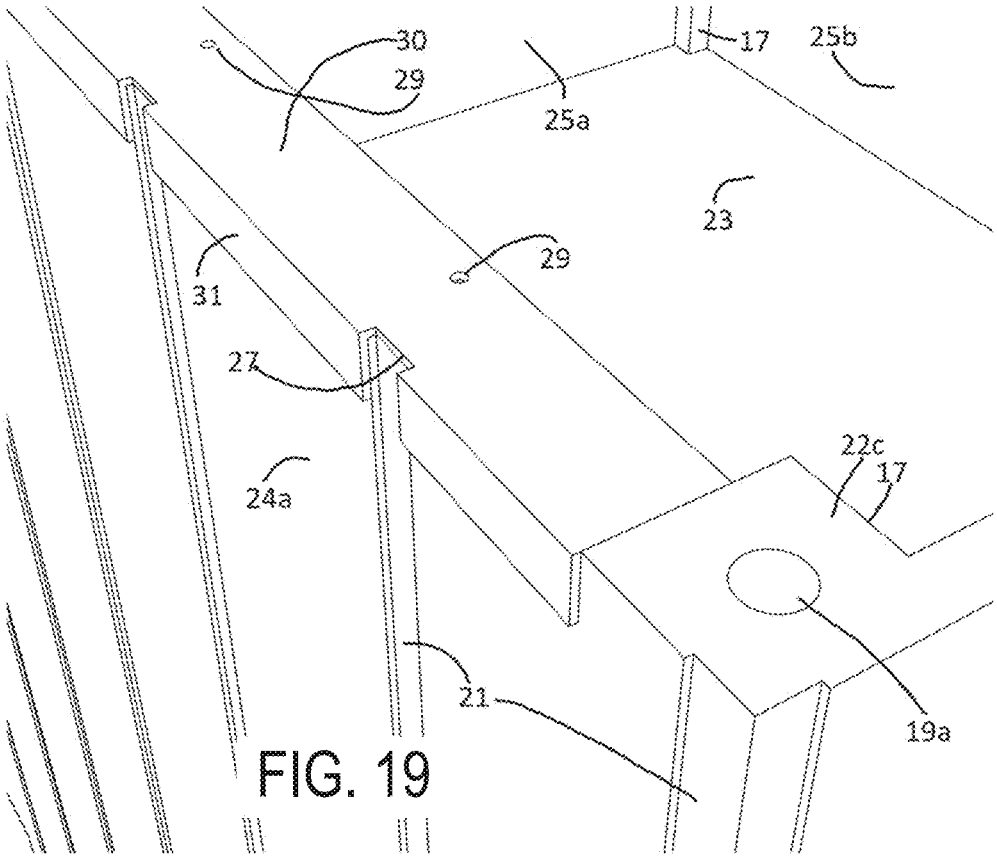
FIG. 19 shows a top of a modular unit wall with an F-bracket in accordance with an embodiment.

FIG. 19 embodies how the F-bracket secures itself to the top of the concrete modular unit's wall 24*a* and 24*b*. It is situated between two columns 22*c* and 22*d*, which provide stability and load transfer. As mentioned previously, the F-bracket sits in the indentation 20 on top of the wall and is flush with the top of the columns 22*c* and 22*d*. This illustration gives a good representation of the cut outs 27 along the exterior portion 31 of the F-bracket, and how vertical strapping can carry past the unit if the detail desires via the vertical indentations 21. The interior detail is the portion that will be carrion and transferring the loads, this flange 30 protrudes into the unit to allow contact points for joist systems, rooming systems, or weight bearing systems, and can be secured using connections points 29 at necessary points.

Figure 20:
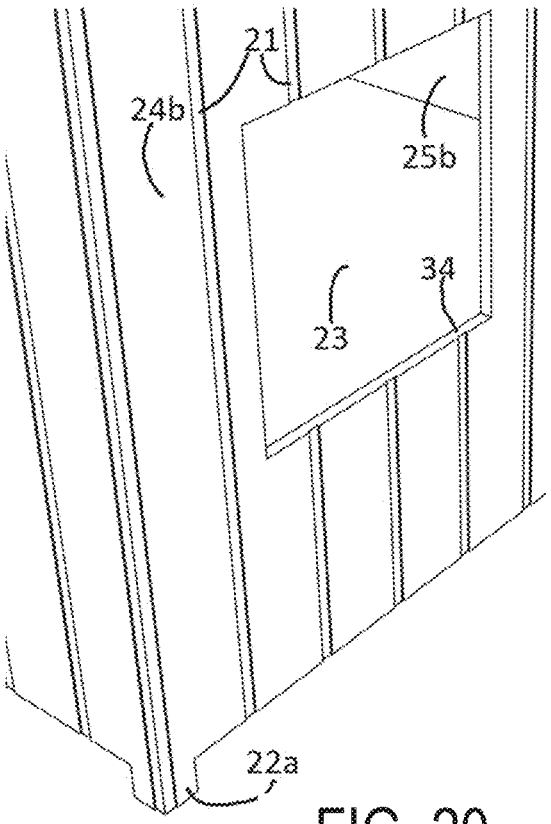
FIG. 20 shows a window detail found in a modular unit in accordance with an embodiment.
Figure 21:
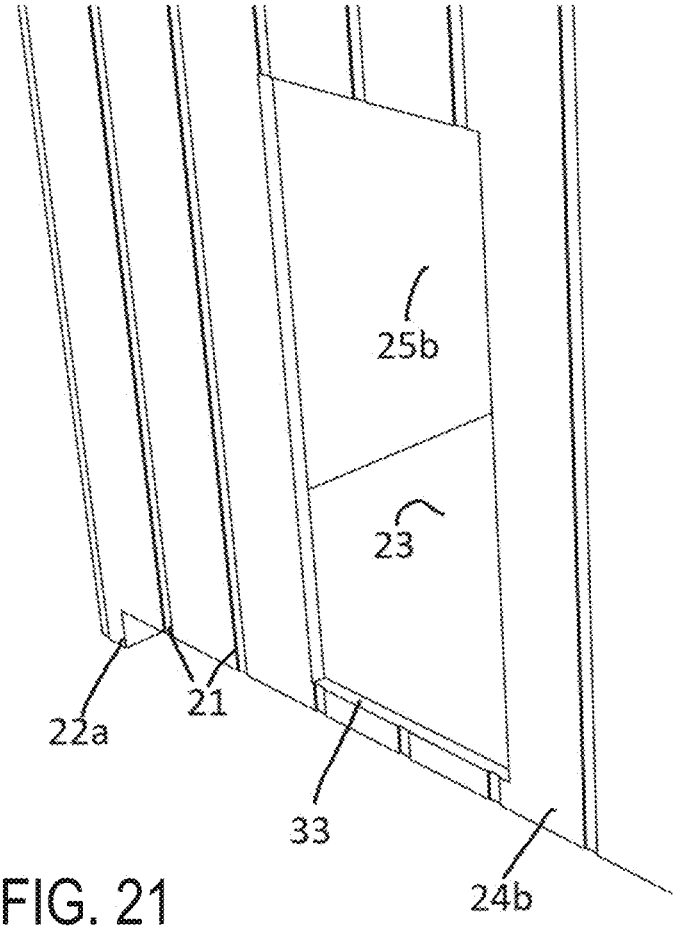
FIG. 21 shows illustrative openings to a modular unit in accordance with an embodiment.

FIG. 20 and FIG. 21 interprets concrete modular units with various opening 33 and 34 incorporated into the form of the body. These openings are specific to the use and structural design of the concrete modular unit, therefore the pre planning allows the openings to be formed and precast into the finished product. This is depicted in FIG. 5 and FIG. 6 shows the example of a window 16 and door 15 secured to the concrete modular unit's mold base 4.

Figure 22:
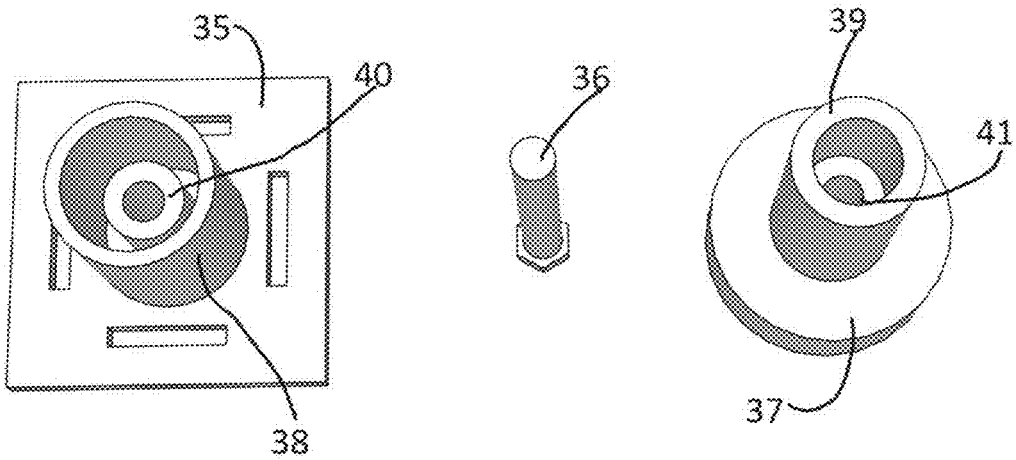
FIG. 22 shows a lifting system for casting into walls of the modular unit in accordance with an embodiment.

FIG. 22 shows a lifting system that will be utilized to transport the concrete modular unit once it is fully cured. The base of the system 35 will be cast into the walls 24*a* and 24*b* modular units at various points depending on the weight and design of the unit. The base of the system 35 is placed into the form with the top portion 38 tight against the form panel 8*a* and 8*b* so that the inside connection 40 is exposed with the cured product. When the unit is ready to transport the top 39 is inserted and secured by a fastener 36 through the center 41 leaving the top exposed 37, this system will allow for standard crane transport and placing on site.

Figure 23:
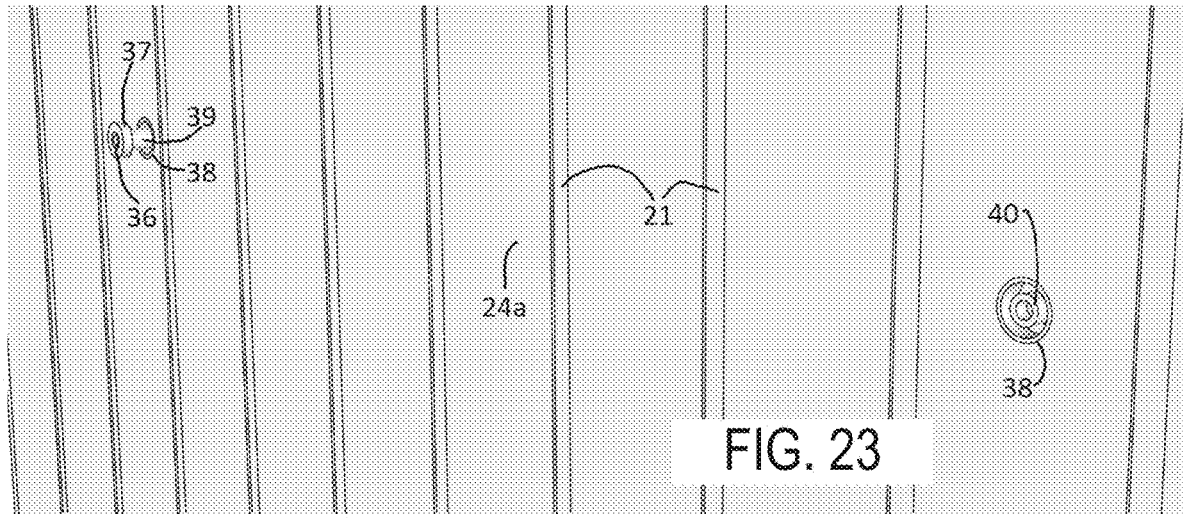
FIG. 23 shows the lifting system cast into the exterior of the modular unit in accordance with an embodiment.

FIG. 23 indicates the application of the lifting system as they are cast in place on the exterior of the modular unit wall. One of the images shows the lift system border 38 and the inside of the cast in place unit where the secondary attachment is connected 40. The other image shows the secondary attachment connected and secured to the cast in place portion of the lift system.

Figure 24:
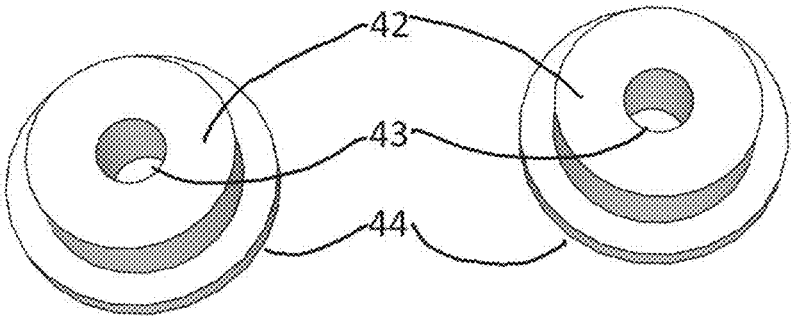
FIG. 24 shows a pair of gaskets adapted to be inserted into holes located in the walls of adjoining modular units.

FIG. 24 shows the gaskets that are inserted into structurally determined holes on either side of the adjoining wall. The flange 44 will be exposed, as the inside portion 42 of the gasket will slide into the hole. Then the two adjoining units will be fastened through the hole 43 that will pass between the two walls.

Figure 25:
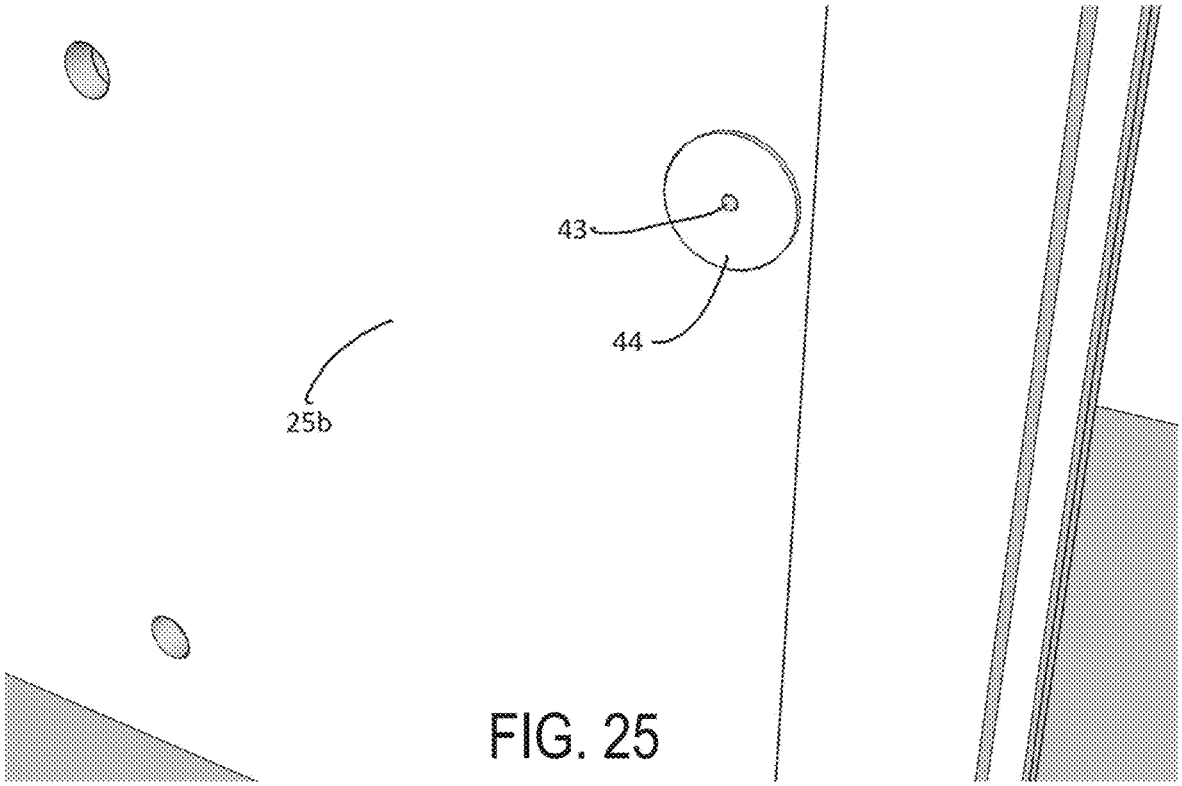
FIGS. 25 and 26 shows how modular monolithic units may be secured to one another utilizing fasteners and gaskets that will be inserted into holes of the adjoining modular units.

FIG. 25 shows when the gasket is fully inserted into the wall with the flange exposed and the hole for the fastener 43.

Figure 26:
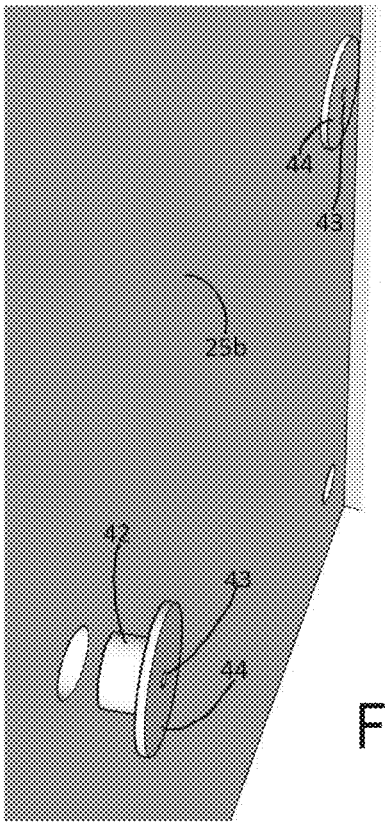

FIG. 26 shows a second gasket being inserted 42 into a structurally determined hole while the flange 44 will still be exposed.

Thus, in an aspect, there is provided a modular building system, comprising: one or more modular building units, each modular building unit having a monolithic construction including a floor and four walls; wherein, each modular building unit includes integrated vertical support columns, each vertical support column having a contact point for stacking the one or more modular units; and when stacked, extending portions of the vertical support columns provide free air space between stacked units.

In an embodiment, each modular building unit is formed as a monolithic concrete structure, and each of the vertical support columns are reinforced concrete columns.

In another embodiment, the vertical support columns are structurally reinforced with steel.

In another embodiment, the contact point of each vertical support column provides a hollowed cylinder of limited depth adapted to receive a portion of a metal dowel for interlocking stacked modular units.

In another embodiment, a modular building unit is rectangular in shape, and is stackable at its support column contact points across two modular building units of an identical rectangular shape or a different shape.

In another embodiment, a modular building unit is stackable at its support column contact points at a perpendicular orientation on top of another modular building unit of identical shape or a different shape.

In another embodiment, the walls include a preformed indentation for receiving a metal ledge between the support columns.

In another embodiment, the metal ledge is an F-ledge configured to carry and disperse weight, and support a joist system mounted thereon.

In another embodiment, each modular building unit has lifting points that are embedded into the walls.

In another embodiment, the lifting points are flush with the walls and comprise metal components adapted to receive an external component which can be inserted and secured into the lifting points before lifting.

In another embodiment, there is provided a modular building method, comprising: providing one or more modular building units, each modular building unit having a monolithic construction including a floor and four walls; providing integrated vertical support columns in the one or more modular building units, each vertical support column having a contact point for stacking the one or more modular units; and staking the one or more modular building units utilizing extending portions of the vertical support columns to provide free air space between stacked units.

In an embodiment, the method comprises comprising forming each modular building unit as a monolithic concrete structure, and forming the integrated vertical support columns utilizing reinforced concrete.

In another embodiment, the method further comprises structurally reinforcing the vertical support columns with steel.

In another embodiment, the method further comprises interlocking stacked modular units at contact points of the vertical support columns utilizing a hollowed cylinder of limited depth adapted to receive a portion of a metal dowel.

In another embodiment, the modular building unit is rectangular in shape, and the method further comprises stacking the units at support column contact points across two modular building units of an identical rectangular shape or a different shape.

In another embodiment, a modular building unit is stackable at its support column contact points, and the method further comprises stacking a building unit at a perpendicular orientation on top of another modular building unit of identical shape or a different shape.

In another embodiment, the method further comprises providing the walls of each modular building unit with preformed indentations for receiving a metal ledge between the support columns.

In another embodiment, the metal ledge is an F-ledge configured to carry and disperse weight, and support a joist system mounted thereon.

In another embodiment, the method further comprises providing each modular building unit with lifting points that are embedded and mounted flush with the walls.

In another embodiment, the method further comprises providing an external component which can be inserted and secured into the lifting points before lifting.

While illustrative embodiments have been described above by way of example, it will be appreciated that various changes and modifications may be made without departing from the scope of the system and method, which is defined by the following claims.

The invention claimed is:

1. A modular building unit, comprising:

a monolithic concrete construction that comprises:

a floor;

four walls; and an interior-projecting vertical support column at each corner of the monolithic construction, wherein each vertical support column is integrated with the walls adjacent to said vertical support column, and wherein each vertical support column extends past the floor to form a column extension providing a contact point for stacking the modular building unit on an additional modular unit and to thereby create a free air space between the modular building unit and the additional modular unit;

wherein the floor of the modular building unit forms a roof for the additional modular building unit when stacked; and wherein the modular building unit is formed as a unitary structure.

2. The modular building unit of claim 1, wherein each of the vertical support columns are reinforced concrete columns.

3. The modular building unit of claim 2, wherein the vertical support columns are structurally reinforced with steel.

4. The modular building unit of claim 3, wherein each column extension comprises a hollowed cylinder of limited depth adapted to receive a portion of a metal dowel for interlocking stacked modular units.

5. The modular building unit of claim 1, wherein the modular building unit is rectangular in shape, and is stackable at its support column contact points across two modular building units of an identical rectangular shape or a different shape.

6. The modular building unit of claim 1, wherein the modular building unit is stackable at its support column contact points at a perpendicular orientation on top of another modular building unit of identical shape or a different shape.

7. The modular building unit of claim 1, wherein the walls include a preformed indentation for receiving a metal ledge between the support columns.

8. The modular building unit of claim 7, wherein the metal ledge is an F-ledge configured to carry and disperse weight, and support a joist system mounted thereon.

9. The modular building unit of claim 1, wherein each modular building unit has lifting points that are embedded into the walls.

10. The modular building unit of claim 9, wherein the lifting points are flush with the walls and comprise metal components adapted to receive an external component which can be inserted and secured into the lifting points before lifting.

11. The modular building unit of claim 1, wherein one or more walls further comprises an interior-projecting centre column that extends past the floor to form a centre column extension to provide an additional contact point for stacking the modular building unit on the additional modular unit and to thereby create the free air space between the modular building unit and the additional modular unit.

12. A modular building system, comprising a plurality of modular building units according to claim 1, wherein the plurality of modular building units are stackable at the contact points on the column extensions to create a free air space between the stacked modular building units, and wherein the floor of the modular building unit forms a roof for the additional modular building unit when stacked.

13. The modular building system of claim 12, wherein each column extension comprises a hollowed cylinder of limited depth adapted to receive a portion of a metal dowel for interlocking stacked modular building units.

14. The modular building system of claim 12, wherein the plurality of modular building units further comprise an interior-projecting centre column integrated with one or more walls that extends past the floor to form a centre column extension to provide an additional contact point for stacking the modular building units.

15. The modular building system of claim 12, wherein the plurality of building units include a preformed indentation on the walls for receiving a metal ledge between the support columns.

16. The modular building system of claim 15, wherein the metal ledge is an F-ledge configured to carry and disperse weight, and support a joist system mounted thereon.

17. The modular building system of claim 12, wherein the plurality of modular building units have lifting points that are embedded into the walls.

18. The modular building system of claim 17, wherein the lifting points are flush with the walls and comprise metal components adapted to receive an external component which can be inserted and secured into the lifting points before lifting.

* * * * *